US006248411B1

(12) United States Patent
Warfel

(10) Patent No.: US 6,248,411 B1
(45) Date of Patent: Jun. 19, 2001

(54) DECORATIVE ROCK PRODUCT

(76) Inventor: Robert C. Warfel, 10N421 Burlington Rd., Hampshire, IL (US) 60140

( * ) Notice: Subject to any disclaimer, the term of this patent is extended or adjusted under 35 U.S.C. 154(b) by 0 days.

(21) Appl. No.: 09/299,855

(22) Filed: Apr. 26, 1999

(51) Int. Cl.[7] ..... B44F 7/00

(52) U.S. Cl. ..... 428/15; 428/919; 428/903.3; 428/35.7; 428/36.4; 428/132; 428/134; 52/103

(58) Field of Search ..... 428/15, 919, 903.3, 428/34.1, 35.7, 36.4, 36.5, 542.2, 131, 132, 134; 119/500; 135/91; 405/25; 52/103

(56) References Cited

U.S. PATENT DOCUMENTS 4,021,131 * 5/1977 Bakken et al. .
4,331,734 5/1982 Stegmeier et al. .
4,385,088 * 5/1983 Baskin .
4,847,026 7/1989 Jarboe et al. .
4,940,558 7/1990 Jarboe et al. .
4,960,622 10/1990 Jarboe et al. .
5,250,250 10/1993 Gorski et al. .
5,395,577 3/1995 Gorski et al. .
5,443,774 8/1995 Klüh et al. .
5,543,100 8/1996 Klüh et al. .
5,782,584 7/1998 Arthur et al. .
5,791,293 * 8/1998 Northrup et al. .
6,033,744 * 3/2000 Bright, Sr. .

* cited by examiner

*Primary Examiner*—Deborah Jones
*Assistant Examiner*—Wendy Boss
(74) *Attorney, Agent, or Firm*—Mathew R. P. Perrone, Jr.

(57) ABSTRACT

A hollow decorative rock protects and provides an aesthetically pleasing appearance by covering utility implements or access covers. Hidden slots in the hollow rock provide for an air flow through the rock, when combined with the uneven bottom edge of the molded hollow rock.

8 Claims, 5 Drawing Sheets

DECORATIVE ROCK PRODUCT

This invention relates to a method of forming a decorative rock and more particularly to a method of forming a decorative with concealed air vents and resulting product.

BACKGROUND OF THE INVENTION

Landscape rocks can serve both a decorative and a practical purpose. A properly positioned rock can add to aesthetic beauty of an area. If the rock is hollow and artificial, it may protect an item otherwise exposed to the elements.

From a purely decorative standpoint, landscape rocks and boulders are known to be used in landscaping to provide a natural effect and to highlight certain areas. To use an actual boulder, it is necessary to (1) find a suitably shaped boulder, (2) transport that boulder to the location of use and then (3) dig the ground around the boulder, in order to (4) rest it within the ground at a suitable height. This process is obviously time consuming and burdensome.

To solve these problems, a variety of alternatives to natural boulders have been developed. Contemporary landscape architects utilize artificial boulders, which are actually hollowed out boulder liners or shells, having a bottom portion cut off to fit flush on the ground. Such liners are typically formed of concrete, which is, in turn, shaped in a mold.

Normally, the mold is formed from an actual boulder. This boulder is selected for its size, shape and design characteristics. By varying the composition or surface treatment of the boulder liner, different colors or surface characteristics can be obtained.

Though contemporary landscape boulder liners have significant functional and economic advantages over actual boulders, the current processes for forming such landscape boulders suffer significant shortcomings. Such problems interfere with both the production rate and the quality of the resulting landscape boulders. The quality of such landscape boulders may be measured by how closely the surface of the landscape boulder reflects the surface details of the actual boulder used in the formation process.

Contemporary precesses for forming landscape boulders typically use fiberglass molds made by forming a latex skin on the surface of the actual boulder, and then constructing the fiberglass mold around the latex skin. Cement is pumped or hand trowelled into the inverted fiberglass mold and allowed to set. The only force acting on the cement is its own weight.

By the action of gravity, the cement generally moves downward toward the bottom of the mold. This feature provides a thicker section of the artificial rock at the upper portion of the artificial landscape boulder when the process is complete. Consequently, the resulting product is weaker and does not have all desired surface characteristics from the mold. This deficiency is particularly significant in the upper and side portions of the inverted landscape boulder.

In order to remedy those deficiencies, it is necessary to apply additional cement by hand to the lower outside portions of the completed landscape boulder. This reduces the chances of the product looking like the original boulder. Such processes have significant deficiencies with respect to both the quality of the resulting product and the production rate.

There is also an additional useful function of an artificial boulder. Increasingly, modern utility lines, such as telephone, electrical, and cable lines, are located underground, rather than in the air suspended by telephone poles, as in the past. While locating utility lines underground provides the advantage of removing unsightly telephone poles and suspended wires from city streets and rural landscapes, it also presents several disadvantages.

Specifically, access to these underground lines is difficult and requires that these lines be periodically brought to the surface and enclosed within a surface enclosure. Consequently, utility companies provide access enclosures for the utility equipment at various above-ground or ground level locations. However, these enclosures are often unsightly, particularly when located in suburban neighborhoods and the like.

While access enclosures of utility companies are extremely durable, in order to protect the equipment, all of the enclosures lack aesthetic appeal. It is highly desirable to provide an aesthetically pleasing cover with strength and durability, with minimal interference with servicing of the utilities through access enclosures.

These utility enclosures do have certain advantages. For instance, they give utility workers the ability to perform maintenance on the lines, as well as the ability to diagnose or enhance the performance of the lines using active and passive devices that are attached to the utility lines in the enclosure.

An above-ground enclosure also provides easy access for changing these devices or otherwise upgrading or providing maintenance on these utility services. For example, above-ground utility enclosures facilitate the task of attaching amplifiers, or line extenders, or other implements to the cable television lines. In this instance, the amplifies act to boost the signal that is transmitted through the line.

Unfortunately, there are also certain drawbacks associated with current utility enclosures. First, the utility enclosures are unattractive in appearance as they typically consist of large box-shaped structures made of unattractive colors. Such devices are especially undesirable in residential areas, where the utility connectors often project upward in the yard of a home and spoil an otherwise well-landscaped yard.

The utility enclosures and connectors contained therein also present another disadvantage in that their current design is impractical. As discussed, amplifiers and other devices are often located in the enclosures where connections are formed in the utility lines to boost the signal carried by the lines. Typically, these type of devices are suspended from an elevated bar that extends upward from the utility connector housing.

However, in current utility connectors, the position of the elevated bar, from which these devices are hung, is fixed. Such a fixed position is undesirable. It does not allow an operator to adjust the location of the bar to suit the various types and sizes of amplifiers or other devices. Moreover, because the position of the bar is fixed, it often interferes with a maintenance person, who is trying to access the utility lines.

Clearly, there is a need for a utility cover that is more aesthetically pleasing, more practical and more convenient for utility maintenance personnel to access for maintenance of the utility services provided therein. However, such a combination of advantages is difficult to obtain.

Polyester fiberglass is a known composition for producing artificial rocks. This material presents a problem, because it requires a gel coat or barrier coat to be first sprayed into the mold. The polyester resin, conventionally employed for structural strength, requires fiberglass filler or reinforcement, in order to avoid problems caused by the inherent brittleness of the polyester resin.

Also, low production with a polyester based material is a problem. Curing times and mold set up time restricts productions to one or two parts per mold per day.

Plaster and concrete have also been employed, but suffer a weight disadvantage, because both are too dense for producing large specimens. Lack of durability, weathering and resistance to cracking and chipping represent further problems. Production is also generally limited to one or two parts per mold per day, with this material.

A particular problem is presented in molding artificial rocks. Such rocks may be made in solid form of one type of plastic or another, but are limited in variety or design, both because of the high cost of molding as well and the time requirement. The time requirement relates to production of both the mold and the molded product. For landscaping purposes, different sizes and types of artificial rocks are desirable, and high mold costs and operation expenses may be limiting factors in the production of such rocks of different size and appearance to simulate a natural setting.

A further problem has been in the presentation of self-supporting supporting substantial rigid artificial rocks of durability, strength and hardness that can withstand the rigors of the environment, wear and tear that will occur from weather, by accident or from intentional efforts to cause damage. Such rocks, if used in an outdoor setting, must be able to withstand a load and weathering over a period of time and substantial physical abuse by the public that may be encountered in the landscape or other type of setting in which they are employed.

Another problem with the artificial rock is that moisture may be trapped inside the rock. Yet providing vents in the artificial rock can easily detract from the aesthetic appearance thereof. If such ventilation can be achieved, while maintaining the aesthetic appearance, great advantages can be achieved.

SUMMARY OF THE INVENTION

Among the many objectives of this invention is to provide an artificial rock with a hollow interior suitable for covering utility items.

Another objective of this invention is to provide an artificial rock with at least one hidden vent in the surface.

Yet another objective of this invention is to provide a durable artificial rock.

Still another objective of this invention is to provide an artificial rock with at least one hidable vent in the base.

Additionally, an objective of this invention is to provide a method for making a decorative rock.

Also, an objective of this invention is to provide a method for making a decorative rock, which stays in a level position.

A further objective of this invention is to provide a method for making a decorative by a molding process.

A still further objective of this invention is to provide a method for making a decorative by a shaping process.

These and other objectives of the invention (which other objectives become clear by consideration of the specification, claims and drawings as a whole) are met by providing a hollow decorative rock adapted to protect and provide an aesthetically pleasing appearance by covering utility implements or access covers.

BRIEF DESCRIPTION OF DRAWINGS

Throughout the figures of the drawings where the same part appears in more than one figure the same number is applied thereto.

DESCRIPTION OF THE PREFERRED EMBODIMENTS

Figure 1:
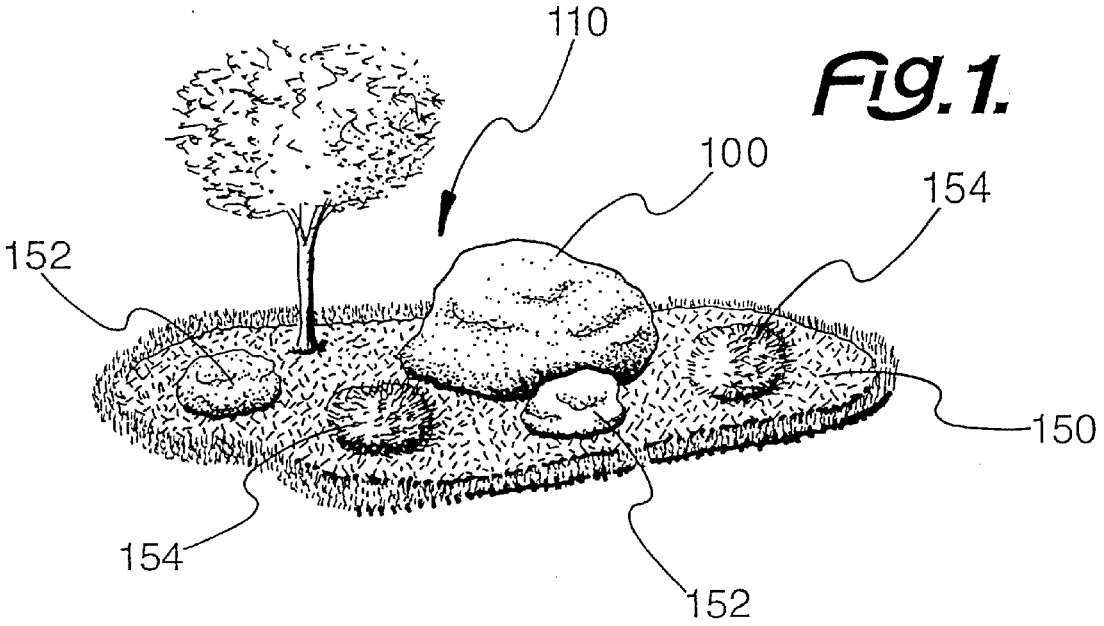
FIG. 1 depicts a perspective view of decorative rock 100 in a garden setting 110.

To form a decorative rock of this invention, a flexible mold is shaped. A layer of a resin and fiber glass mixture is placed over the mold. The resin and fiber glass mixture is thicker at the bottom of the mold. Air holes can be formed in layer of the resin mixture in the mold due to flaps on the mold. With the flaps on the mold, hidden air holes are produced on the interior of the decorative with an upper and lower lip.

The bottom edge of the artificial boulder is uneven or variegated. Between the air holes and the uneven bottom edge in contact with the ground, an air flow passes through the hollow boulder or rock, and permits or causes evaporation of moisture away from the equipment.

Depending on the shape of the mold, the artificial boulder or rock can be formed to cover a number of utility boxes and other items. Typical utility items to be concealed or covered include, but are not limited to a well head, an individual aeration treatment plant, an individual home aeration plant, a septic tank riser, a manhole, a sewer cleanout, and any pipe which sticks above ground.

Typical home items can also be covered by the artificial boulder. Typical house related function include covering a furnace vent on a house, a lift station, and a pump for an artificial waterfall. The mold can also use recycled fiberglass in the above application, thereby solving an environmental problem. Chiselled looking letters, numbers or other members may be formed. A train tunnel for use with a model train can also be formed.

The big advantages of these products are the extra strength, color variations and use of material, which otherwise are destined for landfills. Fiberglass can be recycled in this process. The strength of the rock or boulder is provided by making the base edge thicker.

Plastic components or hardenable resins, having a wide variety of applications, are produced from modern, state of the art, engineering grade molding resins. Typical of these resins used in a molding process are polyphthalamide available under the trademark AMODEL from AMOCO, Inc., of Chicago, Ill.; polycyclohexylenediamine-ethyleneterephthalate available under the trademark EKTAR from Eastman Kodak, Inc, of Rochester, New York; polyphenylene sulfide available under the trademark RYTON from Phillips Petroleum, Inc. of Bartlesville, Okla.; and liquid crystal polymer available under the trademark VECTRA from Celanese, Inc. of Wilmington, Del.

One suitable process for making the fiberglass-based hollow boulder or rock is as follows. A foamed block of artificial resin is formed to a size based on the desired size of the hollow rock. A recyclable cardboard box or similar box of suitable size is obtained. Resin is formed and foamed within the box in a standard fashion. After standing for a day, the block of foamed resin is then removed.

Then the foamed block of artificial resin of the desired size is shaped to the desired look needed for the artificial boulder by using a saw, a sander or a similar device. Two pound Foamtek block, available from IPC International, Inc., which is a company doing business in Elkton, Md., is a desired material. Such a shaped foam block makes the basic foam mold.

Any undesired holes in the foam mold can be filled. A preferred filler is fiberglass putty. The hidden air holes, desired in the final product, will be left open or shaped in the foam block. The shaped foam mold is then sprayed with a curable or hardenable liquid sprayable resin. A preferred sprayable resin is a polyester styrene resin.

When the resin is dry, it is then coated with a release agent. A preferred release agent Partial Film #10 release agent available from Rexco, which is a company doing business in Conyers, Ga.

Over the release agent, a latex or silicone rubber composition is applied. That rubber composition is cured or dried as required. Preferably, the rubber composition for the mold is about 0.2 to about 0.6 centimeters thick. More preferably, the rubber composition for the foam mold is about 0.3 to about 0.6 centimeters thick. Most preferably, the rubber composition for the mold is about 0.3 to about 0.5 centimeters thick.

Now that a female mold is thus made, the rubber coat is removed from the foam mold. The foam mold is then trimmed in any suitable manner to form a second male mold. Such trimming can even be done with a hand saw. For example, a hand saw can cut on three sides of the foam mold, about nine centimeters. A flexible sheet is placed a over the foam mold. The flexible sheet is preferably a plastic sheet. Use of the sheet prevents the rubber mold sticking to the foam mold, which can be caused by heat generating in curing the resin used to form the hollow rock.

With the rubber mold placed over the plastic sheet and a mold release agent applied to the rubber mold, a spacing device is placed between the sheet and foam mold. The spacing device may be a suitably shaped piece of wood or similar material. A typical example is a one foot long piece of the commonly defined two by six (two inches by six inches) piece of wood between the rubber and the plastic sheet in the places that the foam had been cut off.

Then a hardenable or curable composition can be used to form the decorative rock. The curable composition is preferably a thermoplastic resin capable of being cured or cross-linked. Mixtures of resins and other thermoplastic resins, which would customarily be discarded, may be used in this process. A general purpose polyester resin is preferred. Also preferred is a polystyrene resin.

Preferably, the resin has a viscosity from 450 to 600 poise. More preferably, the resin has a viscosity from 475 to 575 poise. Most preferably, the resin has a viscosity from 500 to 575. The resin is mixed with a thickener. If the amount of resin is reduced, a resin gel may be used.

The resin is preferably present in an amount of fifteen percent to ninety five percent by volume of the total mixture. More preferably, the resin is preferably present in an amount of twenty percent to eighty five percent by volume. Most preferably, the resin is preferably present in an amount of twenty five percent to eighty five percent by volume.

To the resin may be added an aerosol thickener in the amount of five percent to twenty five percent volume of the total mixture. More preferably, the aerosol thickener is added in the amount of ten percent to twenty percent. Most preferably, the aerosol thickener is added in the amount of ten percent to fifteen percent.

If it is desired to reduce the resin, zero to forty percent resin gel with coloring pigments may be used. More preferably, up to forty percent resin gel may be used. Most preferably, up to thirty five percent resin gel may be used.

The curing agent is used in an amount of up to fifteen percent by volume of the mixture. More preferably, the curing agent is used in an amount of up to ten percent by volume of the mixture. Most preferably, the curing agent is used in an amount of up to five percent by volume of the mixture.

To the mixture before curing is added up to forty percent fiberglass filler by weight of the mixture with thorough mixing. More preferably, up to thirty five percent fiberglass filler by weight is added. Most preferably, up to thirty percent fiberglass filler by weight is added. Preferably, the fiberglass is recycled. Such recycling solves two problems. It (1) reduces waste in an (2) aesthetically pleasing manner.

In order to provide an appropriate color to a hollow rock or boulder of this invention, a coloring solution is formed, applied to the surface and cured. Based on the volume of the coloring solution alone, the coloring solution includes forty to 150 parts of a base coloring resin. To the base coloring resin is one to ten parts pigment by volume of the coloring solution. Also to the color solution is added up 0.5 parts curing agent based on the volume of coloring solution. The curing agent hardens the coloring and secures it to the rock.

Pigment can be determined on a repetitive basis and depends on darkness or lightness and type of color. Therefore ten parts to fifty parts of coloring may be used, base on the volume of the solution.

More preferably, based on the volume of the coloring solution alone, the coloring solution includes fifty to 150 parts of a base coloring resin. To the base coloring resin is one to nine parts pigment by volume of the coloring solution. Also to the color solution is added up to 0.4 parts curing agent based on the volume of coloring solution.

Most preferably, based on the volume of the coloring solution alone, the coloring solution includes sixty to 140 parts of a base coloring resin. To the base coloring resin is one to eight parts pigment by volume of the coloring solution. Also to the color solution is added up 0.3 parts curing agent based on the volume of coloring solution.

Any liquid hardener is suitable for the coloring solution. The hardener is organic peroxide Type D liquid hardener available from Elf Ato Chemicals of Philadelphia, Pa.

A preferred coloring agent is an inorganic metal oxide coloring. The amounts vary depending on how dark the color should be. For black and tan colors, metal shavings from reground brake drums is used. This colored resin is rolled on the molded rock in order to flatten any fiberglass that sticks out. Such rolling also adds a second color to the rock by having more color in some spots than others. Also with the rolling of the fiberglass in rock as formed and before curing, the desired texture can be created. A third color may also be added to the rock in similar fashion.

The coloring solution is applied to the rock in any suitable fashion. Spraying, painting and dipping are used. Painting is preferred to handle and conceal protruding fiberglass fibers.

In FIG. 1, decorative rock 100 is in a garden setting 110. The garden setting 110 also has some mulch 150 and a plurality of smaller rocks 152, with bushes 154. This decorative rock 100 can be easily moved and permit an easy change of the decoration if desired.

Figure 2:
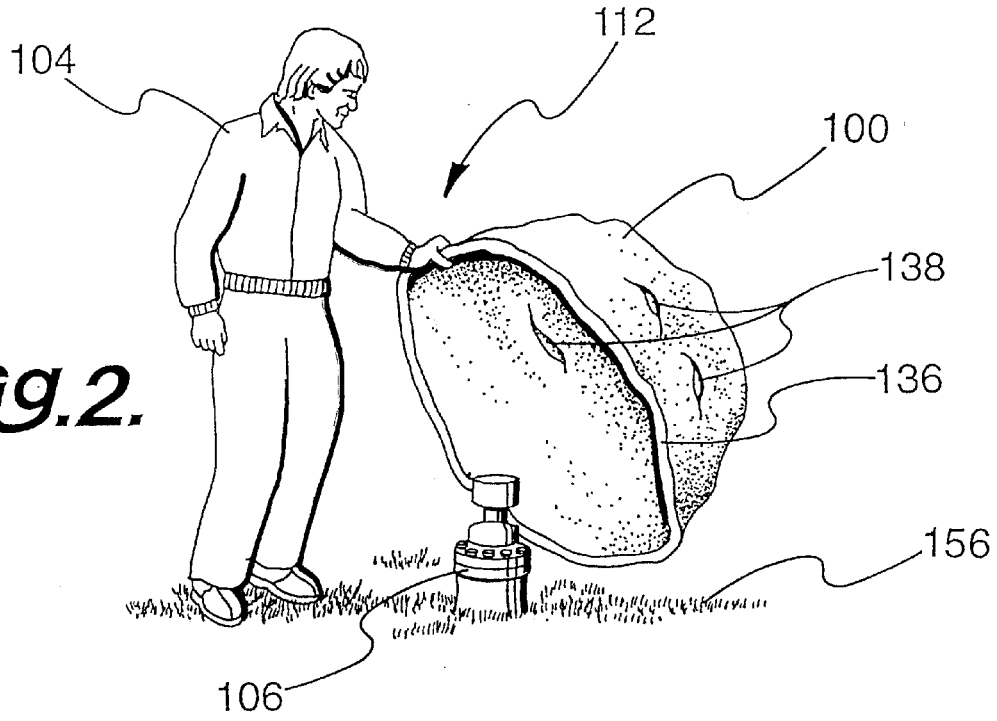
FIG. 2 depicts a perspective view of decorative rock 100 in a concealed setting 112.

With FIG. 2, decorative rock 100 is placed over a well head 106 placed in a concealed setting 112. This cutaway view of decorative rock 100 shows that decorative rock 100 can be used to conceal, that which is desired to be concealed, in this case, well head 106.

More specifically, a man 104 has lifted decorative rock 100, in order to expose a well head 106. The bottom edge 136 of decorative rock 100 is not coplanar. Hidden vents 138 combine with bottom edge 136 to provide air flow through the decorative rock 100 and minimize moisture buildup thereunder.

Figure 3:
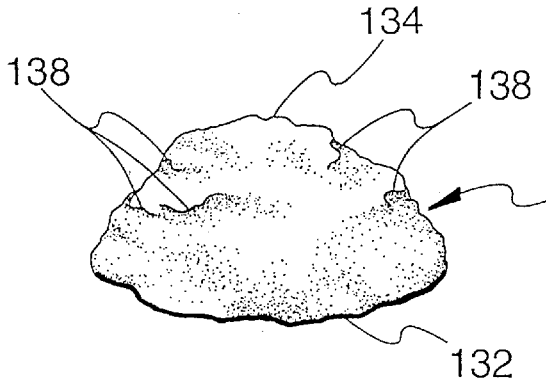
FIG. 3 depicts a perspective view of decorative rock 100.
Figure 4:
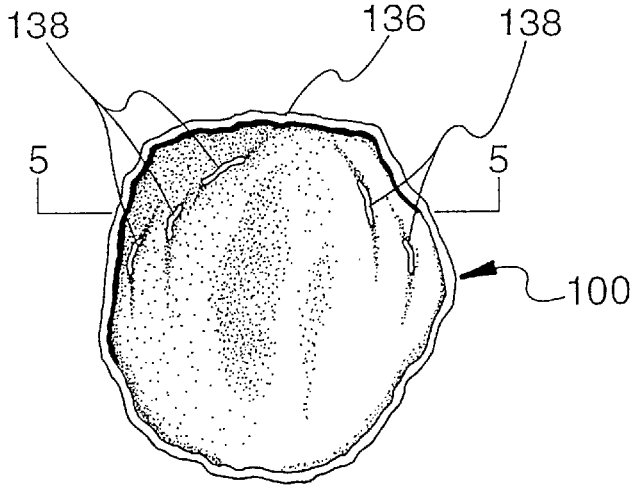
FIG. 4 depicts a bottom plan view of decorative rock 100.
Figure 5:
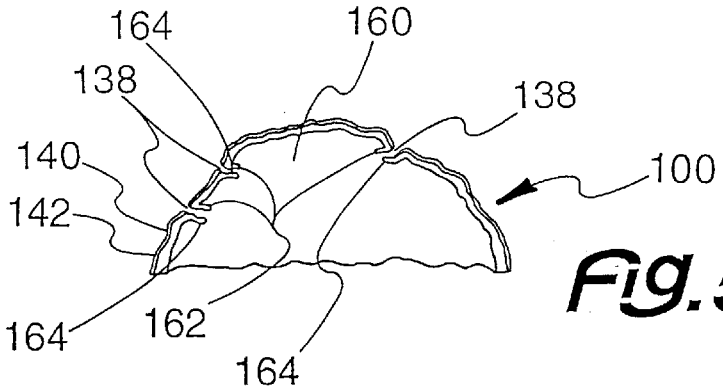
FIG. 5 depicts a side, cross-sectioned view of decorative rock 100.

In order to consider the structure of decorative rock 100, one must consider FIG. 3, FIG. 4 and FIG. 5 together. The fiber glass filled resin 130 forming decorative rock 100 is thicker at the rock base 132 and tapering to a thinner rock top 134. This structure permits it to support 100 kilograms or more.

The bottom edge 136 of rock base 132 is uneven, that is not coplanar. That rock base 132 with the hidden vents 138 invisible to a top or side view of decorative rock 100, provides airflow through the decorative rock 100. This airflow helps protect whatever the rock 100 covers and minimizes moisture collection thereunder. The tapered structure of decorative rock 100 provides strength and durability. The powdered layer 140 and the colored layer 142 are depicted and add to the concealing features.

During the molding process, the resin and mold for the decorative rock 100 have sufficient structure to form hidden vents 138. From hidden vent 138, upper vent lip 162 and lower vent lip 164 extend to the interior 160 of decorative rock 100. This structure provides the hidden vent 138. As many hidden vents 138 as desired may be provided.

Figure 6:
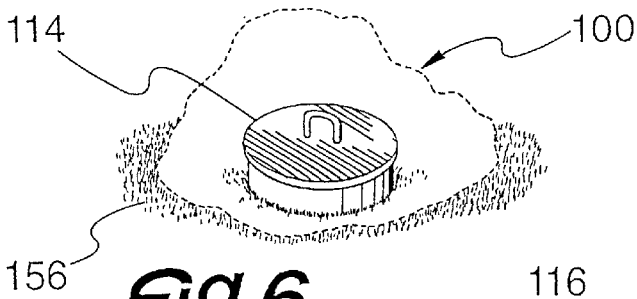
FIG. 6 depicts a perspective, phantom view of decorative rock 100, covering a manhole 114.
Figure 7:
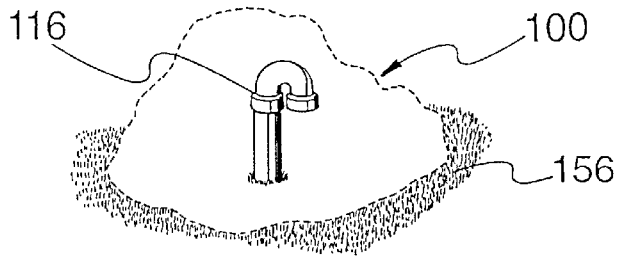
FIG. 7 depicts a perspective, phantom view of decorative rock 100, covering a tank vent 116.
Figure 8:
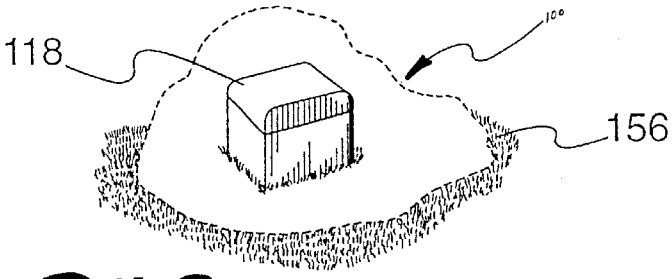
FIG. 8 depicts a perspective, phantom view of decorative rock 100, covering a utility box 118.

FIG. 6, FIG. 7, FIG. 8, FIG. 9, FIG. 10, FIG. 11 and FIG. 12 depict a variety of uses for decorative rock 100. FIG. 6 depicts it used as a covering for a manhole 114. FIG. 7 shows a use covering a tank vent 116. FIG. 8 has a covering for a utility box 118.

Figure 9:
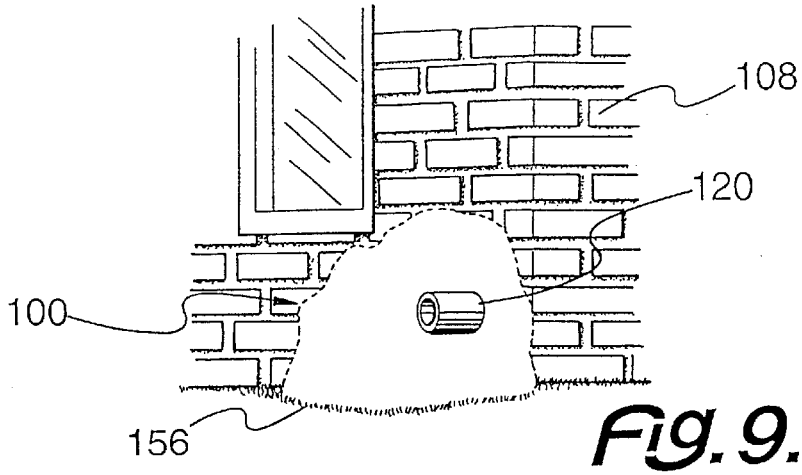
FIG. 9 depicts a perspective, phantom view of decorative rock 100, covering a wall vent 120.
Figure 10:
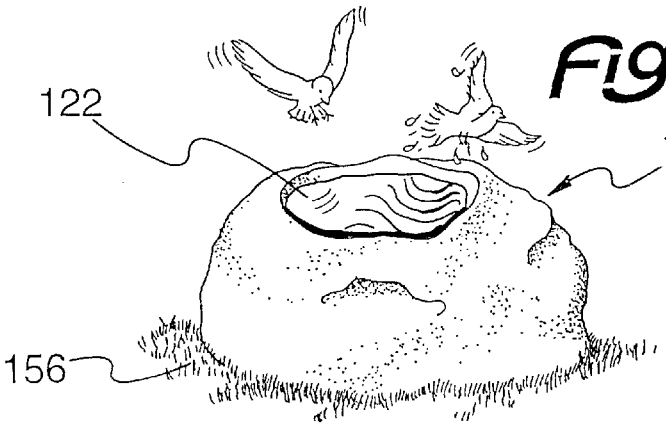
FIG. 10 depicts a perspective view of decorative rock 100 used as a bird bath 122.
Figure 11:
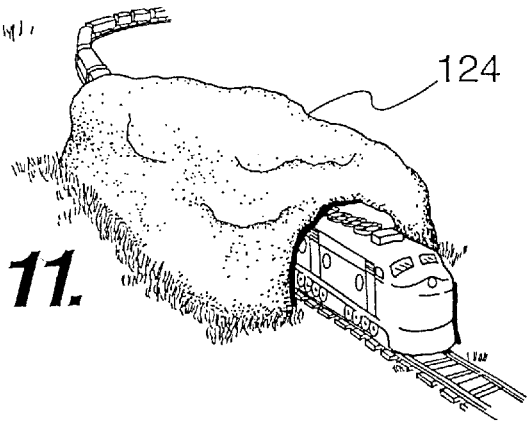
FIG. 11 depicts a perspective view of decorative rock 100 used as a train tunnel 124.

Other uses are possible. FIG. 9 depicts decorative rock 100, covering a wall vent 120, on a house 108. FIG. 10 depicts decorative rock 100 used as bird bath 122. FIG. 11 depicts decorative rock 100 used as model train tunnel 124.

Figure 12:
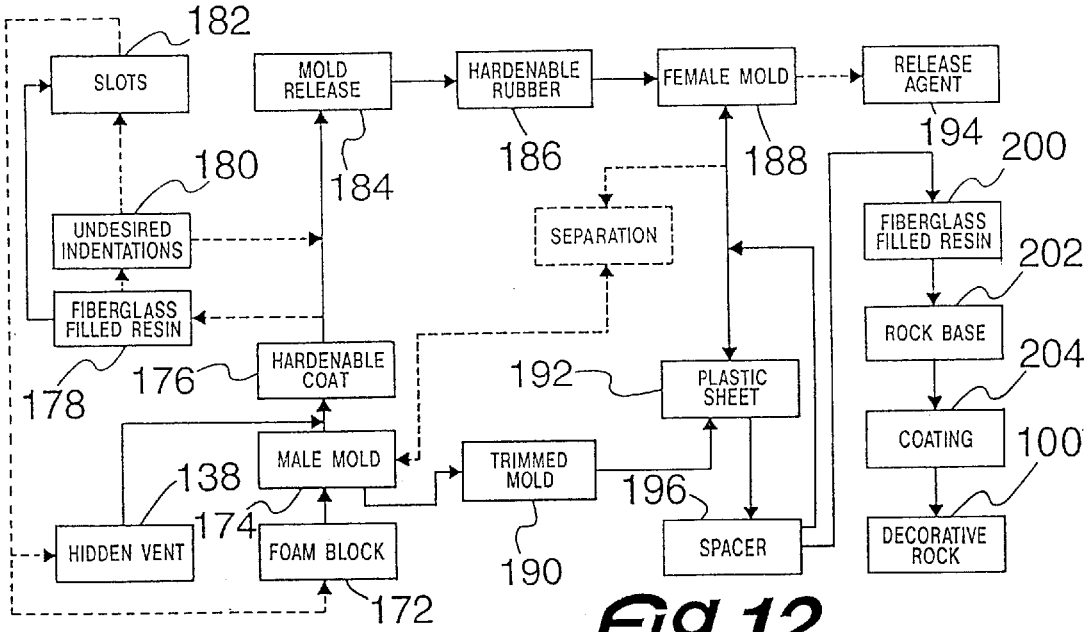
FIG. 12 depicts a block diagram of the foamed block method of making of decorative rock 100.

As shown in FIG. 12, a box 170 of desired size has a foamed block 172 formed by placing at least one resin and at least one desirable resin foaming agent therein. Various cuts are made in foamed block 172 to form male mold 174. Male mold 174 has a hardenable coat 176 sprayed thereon or otherwise applied thereto.

If required, fiberglass filled resin 178 is used to fill any undesired indentations 180 or otherwise applied thereto. Slots 182 in male mold 174 provide for the formation of each hidden vent 138. Each slot 182 is formed in male mold 174 by any standard fashion. A slot 182 may be formed by cutting, gouging, or another manner. A slot 182 may even form during the foaming process, which slot 182 is not blocked with fiberglass filled resin 178. Fiberglass filled resin 178 is preferred filler, although other fillers may be used.

Over the hardenable coat 176 is sprayed or otherwise applied a mold release 184. A hardenable rubber 186 is applied over the mold release 184, and is cured or allowed to cure in order to form a female mold 188. Female mold 188 is separated from male mold 174.

Male mold 174 is then trimmed to form trimmed mold 190. Trimmed mold 190 is covered with a plastic sheet 192, which keeps female mold 188 from sticking to the trimmed mold 190. Female mold 188 is optionally coated with a release agent 194. Spacers 196 are placed between plastic sheet 192 and female mold 178.

Fiberglass filled resin 200 is trowelled or otherwise placed between the trimmed mold 190 and female mold 188 and allowed to harden. Fiberglass filled resin 200 thus forms rock base 202 on hardening. Appropriate desired coatings 204 are then applied as desired to complete decorative rock 100.

Figure 13:
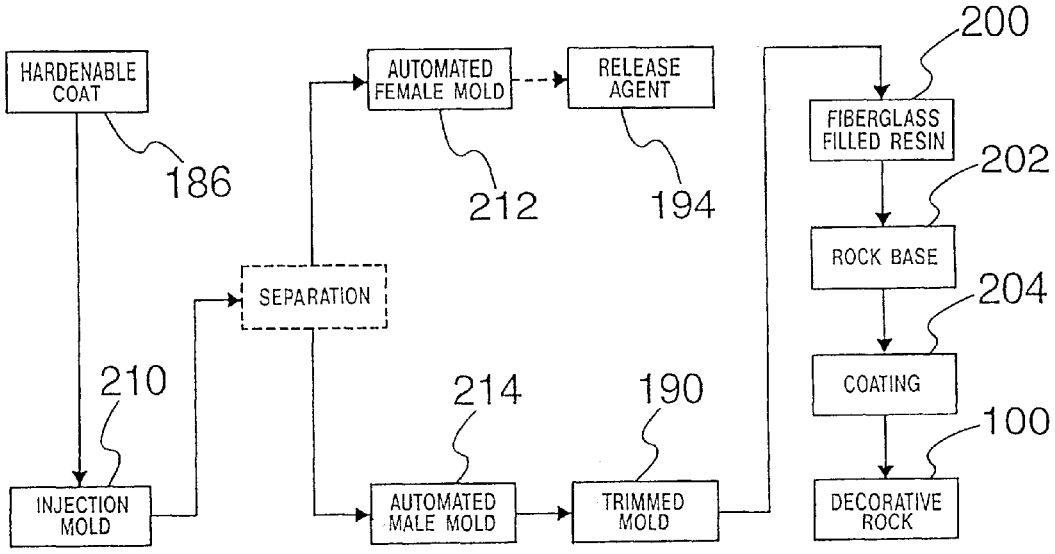
FIG. 13 depicts a block diagram of the molded shape method of making of decorative rock 100.

In FIG. 13 injection mold 210 replaces the reshaping function of foam 172. The hardenable rubber 186 flows into an appropriately shaped injection mold 210. After the rubber 186 is hardened, it is released from the injection mold 210. The procedure of FIG. 13 is then repeated, relative to the trowelling of the fiberglass filled resins 200.

In the following examples, which are intended to illustrate without unduly limiting the invention, all parts and percentages are by volume, unless otherwise specified.

EXAMPLE 1

A foamed block of polystyrene is shaped to the desired look needed for the artificial boulder by using a saw. Undesired holes in the foam mold are filled with fiberglass putty. The hidden air holes, desired in the final product, are formed by slots left open or shaped in the foam block. The shaped foam block is then sprayed with a polyester styrene sealing resin.

When the sealing resin is dry, undesired holes in foam block are filled with commercially available fiberglass filled resin putty. A hardenable rubber coating, which may be formed of waste resin, to the shaped foam block or male mold.

After the rubber coating hardens, it is removed from the foamed block. The foam mold is then trimmed in any suitable manner on three sides of the foam mold, about nine centimeters. A plastic sheet is placed over the foam mold. With the rubber mold placed over the plastic sheet and a mold release agent applied to the rubber mold, two or three pieces of wood are placed between the rubber and the plastic sheet in the places that the foam had been cut off.

A rock forming resin is formed and placed with a trowel between the plastic sheet and the rubber mold. The rock forming resin is as follows.

To four hundred parts by volume general purpose polyester resin is mixed one hundred ten parts of an aerosol thickener. Then 3.75 parts of organic peroxide liquid hardener is added and mixed. Then thirty percent by weight recycled fiberglass is added to the mixture and mixed thoroughly.

The mixed resin is applied, using a cardboard spreader, to the rubber mold about 1.0 centimeters to about 3.6 centimeters thick at the bottom, going up the sides about 15 centimeters, and about 0.1 centimeter to about 1.0 centimeter thick the rest of the way up the sides of the rock base to the top of the rock. This process can also be done with a machine that stamps out the mold.

More preferably, the mixed resin is applied, using a cardboard spreader, to the rubber mold about 1.2 centimeters to about 3.0 centimeters thick at the bottom, going up the sides about 13 centimeters, and 0.2 centimeter to 0.8 centimeter thick the rest of the way up the sides and top.

Most preferably, the mixed resin is applied, using a cardboard spreader, to the rubber mold about 1.2 centimeters to about 2.6 centimeters thick at the bottom, going up the sides about 10 centimeters, and about 0.3 centimeter to about 0.5 centimeter thick the rest of the way up the sides and top.

After the resin has hardened, the pieces of wood are removed from between the rubber mold and plastic sheet. The foam block is removed. Then the rubber mold is peeled from the fiberglass form of the decorative rock.

The decorative rock is cut and ground to remove all extra overlay fiberglass . The whole rock is lightly ground for any extra fiberglass pieces that are sticking out.

To color the rock, one part of coloring solution is painted thereon. The coloring composition includes, based on the coloring composition, 20 parts polyester styrene resin, and 0.5 parts of organic peroxide type D liquid hardener in it. To complete the coloring solution four parts of inorganic metal oxide coloring based on the coloring solution is added.

This colored resin is rolled on the mold to flatten any fiberglass that sticks out and adds a second color to the rock by having more color in some spots than others. With the rolling, the desired texture can be created.

EXAMPLE 2

A third desired color can be formed and added to the rock. This third solution has one part inorganic metal oxide, five parts polyester styrene resin and five parts quart of clear marine gel coat, and 0.2 parts organic peroxide type D by volume of the third desired color.

The third desired color is sprayed on the rock, before the resin dries. Immediately a sand blaster applies sand to the still wet rock. A premixed sand is blown on the foam.

Then a premixed powder is lightly tossed over the entire form. More powder is added if the resin keeps coming through. When the resin has dried, the loose sand and powder is blown off with an air compressor.

The sand mixture is one percent granite fill powder, five percent mason sand and the rest silica sand, all by weight of the sand mixture. Amounts vary depending on the desired color.

The powder mixture contains 25% mason sand, 25% silica sand, 2% microspheres for coloring, and the rest is the desired color granite fill powder. All percentages can vary depending on color and texture desired for the finished product.

EXAMPLE 3

The procedure of Example 1 is repeated except that metal shavings from reground brake drums is used. A black and tan colored rock is produced.

EXAMPLE 4

About two hundred forty parts by volume general purpose polyester resin are mixed with one hundred sixty parts by volume polyester styrene gel coat available from CCP of Kansas City, Mo., and five parts of an aerosol thickener fumed silica available from Degusso of Ridgefield, N.J. The gel coat may include coloring pigments. Then 1.5 parts by volume of Organic Peroxide Type D liquid hardener (available under the trademark MEKP, from ELF Ato Chemicals of Philadelphia, Pa., and is added and mixed with the resin. Then one hundred twenty parts by weight of recycled fiberglass are added to the resin and mix thoroughly.

The mixed resin is applied, using a cardboard spreader, to the rubber mold about 2.5 centimeters thick at the bottom, going up the sides eight centimeters and 0.6 centimeter thick the rest of the way up the sides and top. This process can also be done with a machine that stamps out the mold.

The second coloring can be as in Example 1 with polyester styrene resin, organic peroxide liquid hardener and inorganic metal oxide coloring or shavings from reground brake drums. This colored resin is rolled on the mold to flatten any fiberglass that sticks out and adds a second color to the rock by having more color in some spots than others. With the fiberglass roller, the desired texture can be created.

After the resin has hardened, the pieces of wood are removed from between the rubber mold and plastic sheet. Next take the foam block mold out. The rubber mold is removed from the fiberglass form.

EXAMPLE 5

The procedure of Example 1 is repeated except that the rubber mold is injection molded. Similar results of Example 1 are achieved to make the hollow rock of this invention.

EXAMPLE 6

The procedure of Example 1 is repeated except that the fiberglass filled resin is sprayed on the mold instead of trowelled therein. Similar results of Example 1 are achieved to make the hollow rock of this invention.

EXAMPLE 7

The procedure of Example 6 is repeated except that the female mold is edge supported with the opening up. The resin is sprayed on the mold. Similar results of Example 1 are achieved to make the hollow rock of this invention.

EXAMPLE 8

The procedure of Example 1 is repeated except that the resin to form the base rock is replaced with 40 to 70 parts by volume calcium silicate, to five parts by volume gel coat, and 30 to sixty parts by volume odd lot thermoplastic resin or resins. This composition is placed in the female mold. Similar results of Example 1 are achieved to make the hollow rock of this invention.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A hollow decorative rock adapted to provide an aesthetically pleasing appearance by covering utility implements or access covers, comprising:

(a) the hollow decorative rock having a concave interior at an open side and an exterior at a closed side;

(b) the open side being oppositely disposed from the closed side;

(c) the hollow decorative rock having a lower edge;

(d) the lower edge having a variegated structure;

(e) the lower edge being thicker than a cross-section of the closed side;

(f) at least one hidden air passage;

(g) the at least one hidden air passage having an upper lip and a lower lip; wherein (h) the upper lip and the lower lip extend to the interior of the hollow decorative rock.

2.The hollow decorative rock of claim 2 comprising:

(a) the at least one thermoplastic resin; and (b) fiberglass filler.

3. The hollow decorative rock of claim 2 comprising.

(a) at least one recycled thermoplastic resin; and (b) filler formed of recycled fiberglass.

4. The hollow decorative rock of claim being adapted to provide at least one selected from the consisting of a utility box cover, a model train tunnel a bird bath.

5. The hollow decorative rock of claim wherein the utility implements are selected the group consisting of a well head, an individual aeration treatment plant, an individual home aeration plant, a s tank riser, a manhole, a sewer cleanout, a furnace vent house, a lift station, a pump for an artificial waterfall an above-ground pipe.

6. The hollow decorative rock of claim 2 wherein:

(a) the lower edge has a thickness of about 1.0 centimeters to about 3.6 centimeters; and (b) the cross-section of the closed side has a thickness of about 0.1 centimeter to about 1.0 centimeter.

7. The hollow decorative rock of claim wherein:

(a) the lower edge has a thickness of about 1.2 centimeters to about 3.0 centimeters; and (b) the cross-section of the closed side has a thickness of about 0.2 centimeter to about 0.8 centimeter.

8. The hollow decorative rock of claims (a) the lower edge has a thickness of about 1.2 centimeters to about 2.6 centimeters; and (b) the cross-section of the closed side has a thickness of about 0.3 centimeter to about 0.5 centimeter.

* * * * *